US006231324B1

(12) United States Patent
Clendenin et al.

(10) Patent No.: US 6,231,324 B1
(45) Date of Patent: May 15, 2001

(54) OLDHAM COUPLING FOR SCROLL MACHINE

(75) Inventors: Harry Clendenin, Sidney, OH (US); James E. Gundermann, Warren, PA (US)

(73) Assignee: Copeland Corporation, Sidney, OH (US)

( * ) Notice: Subject to any disclaimer, the term of this patent is extended or adjusted under 35 U.S.C. 154(b) by 0 days.

(21) Appl. No.: 09/496,808

(22) Filed: Feb. 2, 2000

(51) Int. Cl.[7] ..... F03C 2/00
(52) U.S. Cl. ..... 418/55.3; 464/102
(58) Field of Search ..... 418/55.3; 464/102

(56) References Cited

U.S. PATENT DOCUMENTS

| | | | | |
|---|---|---|---|---|
| 4,121,438 | | 10/1978 | McCullough . | |
| 4,877,382 | * | 10/1989 | Caillat et al. | 418/55.3 |
| 4,992,033 | | 2/1991 | Caillat et al. . | |
| 5,080,566 | * | 1/1992 | Sakata et al. | 418/55.3 |
| 5,275,543 | | 1/1994 | Tanaka et al. . | |
| 5,320,506 | * | 6/1994 | Fogt | 418/55.3 |
| 5,330,334 | | 7/1994 | Bush et al. . | |
| 5,382,144 | | 1/1995 | Tanaka et al. . | |
| 5,403,172 | * | 4/1995 | Blass et al. | 418/55.3 |
| 5,407,335 | * | 4/1995 | Caillat et al. | 418/55.5 |
| 5,538,408 | | 7/1996 | Blass et al. . | |
| 5,582,512 | | 12/1996 | Bush . | |
| 5,704,773 | | 1/1998 | Higashiyama . | |
| 5,897,306 | * | 4/1999 | Beck | 418/55.3 |

FOREIGN PATENT DOCUMENTS

| | | | | |
|---|---|---|---|---|
| 63-088288 | * | 4/1988 | (JP) | 418/55.3 |
| 2-227581 | * | 9/1990 | (JP) | 418/55.3 |

* cited by examiner

*Primary Examiner*—Thomas Denion
*Assistant Examiner*—Theresa Trieu
(74) *Attorney, Agent, or Firm*—Harness, Dickey & Pierce, P.L.C.

(57) ABSTRACT

An Oldham coupling for a scroll machine has two posts rather than the traditional four posts. Each post of the Oldham coupling of the present invention defines two keys. One key is for engagement with the orbiting scroll. The other key is for engagement with the non-orbiting scroll in one embodiment or for engagement with the main bearing housing in another embodiment. The two posts of the Oldham coupling can be connected by a continuous ring or the two posts of the Oldham coupling can be connected by a connecting member extending between the two posts.

32 Claims, 4 Drawing Sheets

OLDHAM COUPLING FOR SCROLL MACHINE

FIELD OF THE INVENTION

The present invention relates generally to scroll machines. More particularly, the present invention relates to a unique Oldham coupling design for use in these scroll machines.

BACKGROUND AND SUMMARY OF THE INVENTION

A class of machines exists in the art generally known as "scroll" machines which are used for the displacement of various types of fluids. Such machines may be configured as an expander, a displacement engine, a pump, a compressor, etc., and the features of the present invention are applicable to any one of these machines. For purposes of illustration, however, the disclosed embodiments are in the form of a hermetic refrigerant compressor.

Generally speaking, a scroll apparatus comprises two spiral scroll wraps of similar configuration, each mounted on a separate end plate to define a scroll member. The two scroll members are interfitted together with one of the scroll wraps being rotationally displaced 180 degrees from the other. The machine operates by orbiting one scroll member (the orbiting scroll) with respect to the other scroll member (the non-orbiting scroll) to produce moving line contacts between the flanks of the respective wraps. These moving line contacts define moving isolated crescent-shaped pockets of fluid. The spiral scroll wraps are commonly formed as involutes of a circle. Ideally, there is no relative rotation between the scroll members during operation, the motion is purely curvilinear translation (no rotation of any line of the body). The relative rotation between the scroll members is typically prohibited by the use of an Oldham coupling.

The moving fluid pockets carry the fluid to be handled from a first zone in the scroll machine where a fluid inlet is provided, to a second zone in the scroll machine where a fluid outlet is provided. The volume of the sealed pocket changes as it moves from the first zone to the second zone. At any one instant of time, there will be at least one pair of sealed pockets, and when there are several pairs of sealed pockets at one time, each pair will have different volumes. In a compressor, the second zone is at a higher pressure than the first zone and is physically located centrally within the machine, the first zone being located at the outer periphery of the apparatus.

The Oldham coupling that prohibits the relative rotation between the scroll members has taken various forms but generally incorporate two pairs of keys projecting from an annular ring. One pair of keys engages slots in the orbiting scroll and the other pair of keys engages slots in the non-orbiting scroll member or a stationary body such as a bearing housing.

While such Oldham couplings which are connected between the two scroll members are effective to prevent rotation between these respective scroll members, they present design and/or assembly problems in regards to positioning of the coupling between the scroll members. Alternatively, in other applications, additional support structure and/or increased shell size may be required to support the Oldham coupling radially outwardly of the scroll members.

The present invention, in one embodiment, provides an Oldham coupling which is capable of directly interconnecting the two scroll members so as to effectively prevent relative rotation therebetween while avoiding potential design problems presented by the prior designs and also reducing the number of locating and positioning surfaces required. The present invention provides an Oldham coupling which has only one pair of posts for engagement with the scroll members. The orbiting scroll member contacts the lower portion of the pair of keys and the non-orbiting scroll member contacts the upper portion of the pair of keys. In one embodiment the single pair of keys is attached to an annular ring and in another embodiment the single pair of keys is attached to an arc segment of an annular ring extending between the keys.

In an additional embodiment of the present invention an Oldham coupling directly interconnects the orbiting scroll member with the main bearing housing to prevent rotation of the orbiting scroll member. This Oldham coupling also has a single pair of keys for engagement with the orbiting scroll member and the main bearing housing. The single pair of keys can be connected to an annular ring or they can be connected to an arc segment of an annular ring.

Other advantages and objects of the present invention will become apparent to those skilled in the art from the subsequent detailed description, appended claims and drawings.

BRIEF DESCRIPTION OF THE DRAWINGS

In the drawings which illustrate the best mode presently contemplated for carrying out the present invention.

DETAILED DESCRIPTION OF THE PREFERRED EMBODIMENT

Although the principles of the present invention may be applied to many different types of scroll machines, they are described herein, for exemplary purposes, embodied in a hermetic scroll compressor, and particularly one which has been found to have specific utility in the compression of refrigerant for air conditioning and refrigeration systems.

Figure 1:
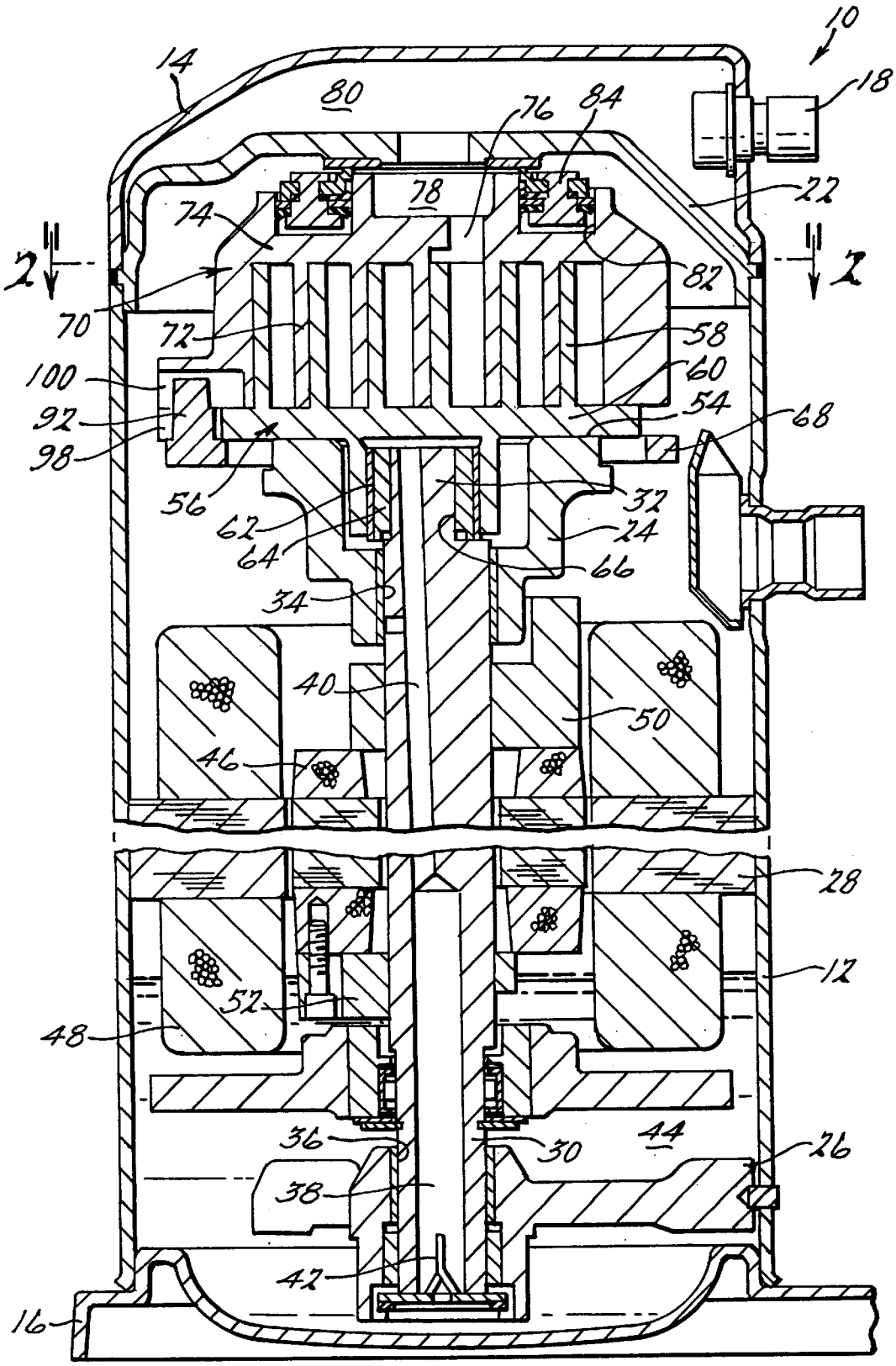
FIG. 1 is a vertical sectional view of a scroll type refrigerant compressor incorporating an Oldham coupling in accordance with the present invention.
Figure 2:
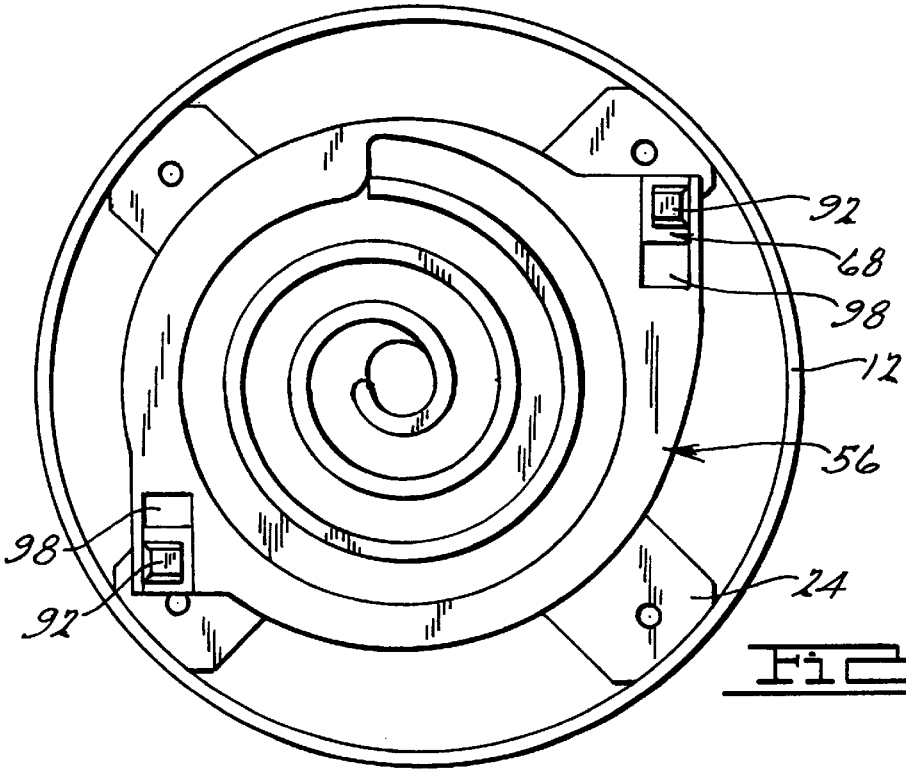
FIG. 2 is a cross-sectional view of the refrigerant compressor of FIG. 1, the section being taken along line 3—3 thereof.

Referring now to the drawings in which like reference numerals designate like or corresponding parts throughout the several views, there is shown in FIGS. 1 and 2 a scroll compressor incorporating the unique Oldham coupling in accordance with the present invention which is designated generally by the reference numeral 10. Scroll compressor 10 comprises a generally cylindrical hermetic shell 12 having welded at the upper end thereof a cap 14 and at the lower end thereof a base 16 having a plurality of mounting feet (not shown) integrally formed therewith. Cap 14 is provided with a refrigerant discharge fitting 18 which may have the usual discharge valve therein (not shown). Other major elements affixed to the shell include a transversely extending partition 22 which is welded about its periphery at the same point that cap 14 is welded to shell 12, a main bearing housing 24 which is suitably secured to shell 12 and a lower bearing housing 26 having a plurality of radially outwardly extending legs each of which is also suitably secured to shell 12. A motor stator 28 which is generally square in cross-section but with the corners rounded off is press fitted into shell 12. The flats between the rounded corners on the stator provide passageways between the stator and shell, which facilitate the return flow of lubricant from the top of the shell to the bottom.

A drive shaft or crankshaft 30 having an eccentric crank pin 32 at the upper end thereof is rotatably journaled in a bearing 34 in main bearing housing 24 and a second bearing 36 in lower bearing housing 26. Crankshaft 30 has at the lower end a relatively large diameter concentric bore 38 which communicates with a radially outwardly inclined smaller diameter bore 40 extending upwardly therefrom to the top of crankshaft 30. Disposed within bore 38 is a stirrer 42. The lower portion of the interior shell 12 defines an oil sump 44 which is filled with lubricating oil to a level slightly above the lower end of a rotor 46, and bore 38 acts as a pump to pump lubricating fluid up the crankshaft 30 and into passageway 40 and ultimately to all of the various portions of the compressor which require lubrication.

Crankshaft 30 is rotatively driven by an electric motor including stator 28, windings 48 passing therethrough and rotor 46 press fitted on crankshaft 30 and having upper and lower counterweights 50 and 52, respectively.

The upper surface of main bearing housing 24 is provided with a flat thrust bearing surface 54 on which is disposed an orbiting scroll member 56 having the usual spiral vane or wrap 58 extending upward from an end plate 60. Projecting downwardly from the lower surface of end plate 60 of orbiting scroll member 56 is a cylindrical hub having a journal bearing 62 therein and in which is rotatively disposed a drive bushing 64 having an inner bore 66 in which crank pin 32 is drivingly disposed. Crank pin 32 has a flat on one surface which drivingly engages a flat surface (not shown) formed in a portion of bore 66 to provide a radially compliant driving arrangement, such as shown in assignee's U.S. Pat. No. 4,877,382, the disclosure of which is hereby incorporated herein by reference. An Oldham coupling 68 is also provided positioned between orbiting scroll member 56 and bearing housing 24 and keyed to orbiting scroll member 56 and a non-orbiting scroll member 70 to prevent rotational movement of orbiting scroll member 56.

Non-orbiting scroll member 70 is also provided having a wrap 72 extending downwardly from an end plate 74 which is positioned in meshing engagement with wrap 58 of orbiting scroll member 56. Non-orbiting scroll member 70 has a centrally disposed discharge passage 76 which communicates with an upwardly open recess 78 which in turn is in fluid communication with a discharge muffler chamber 80 defined by cap 14 and partition 22. An annular recess 82 is also formed in non-orbiting scroll member 70 within which is disposed a seal assembly 84. Recesses 78 and 82 and seal assembly 84 cooperate to define axial pressure biasing chambers which receive pressurized fluid being compressed by wraps 58 and 72 so as to exert an axial biasing force on non-orbiting scroll member 70 to thereby urge the tips of respective wraps 58, 72 into sealing engagement with the opposed end plate surfaces of end plates 74 and 60, respectively. Seal assembly 84 is preferably of the type described in greater detail in U.S. Pat. No. 5,156,539, the disclosure of which is hereby incorporated herein by reference. Non-orbiting scroll member 70 is designed to be mounted to bearing housing 24 in a suitable manner such as disclosed in the aforementioned U.S. Pat. No. 4,877,382 or U. S. Pat. No. 5,102,316, the disclosure of which is hereby incorporated herein by reference.

Figure 3:
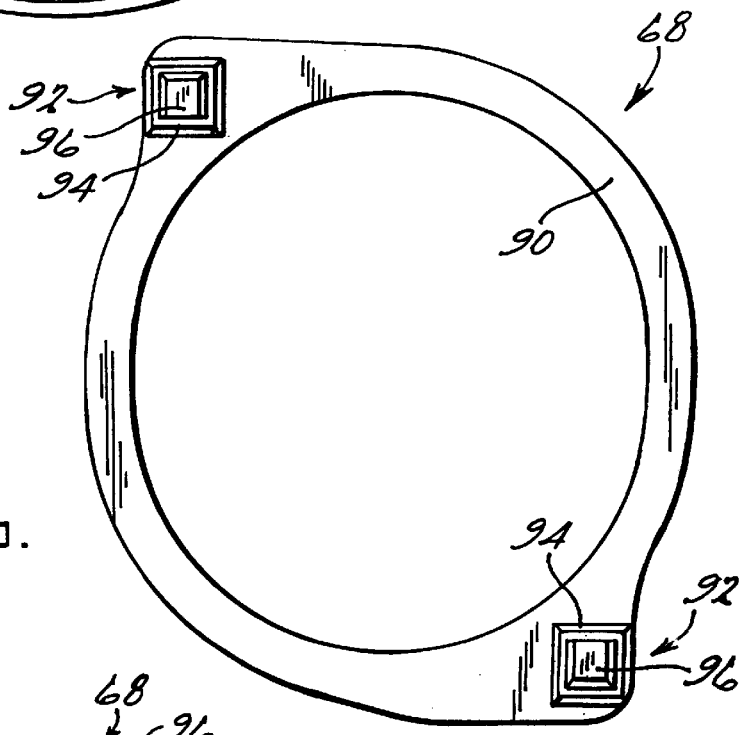
FIG. 3 is a top plan view of the Old-ham coupling shown in FIGS. 1 and 2.
Figure 4:
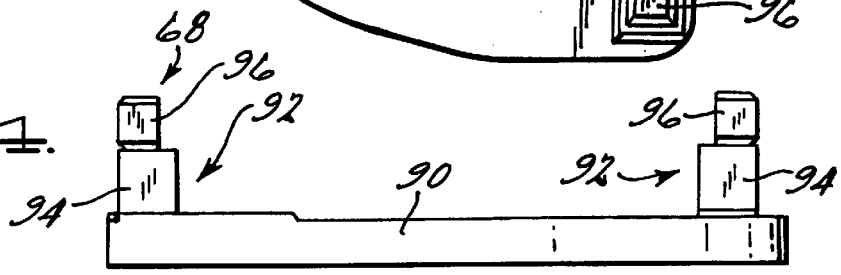
FIG. 4 is a side elevational view of the Old-ham coupling shown in FIG. 3.
Figure 5:
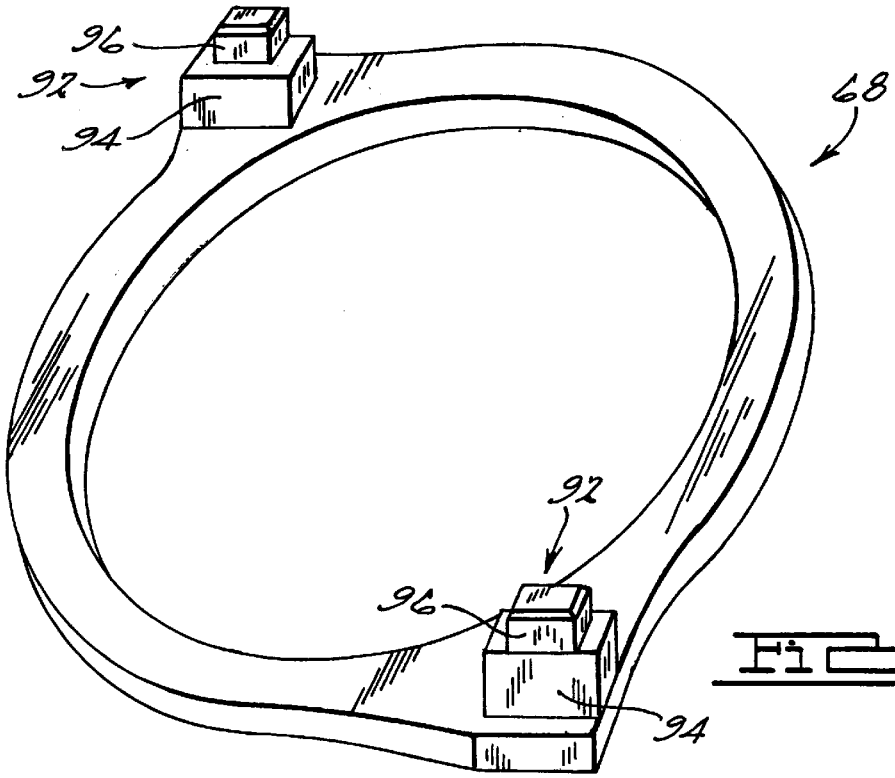
FIG. 5 is a perspective view of the Old-ham coupling shown in FIGS. 3 and 4.

The present invention is directed to the unique Oldham coupling 68 illustrated in FIGS. 3–5. Oldham coupling 68 comprises a ring 90 having two upwardly projecting diametrically opposing integral posts 92. Each post 92 includes an orbiting scroll engagement key 94 and a non-orbiting scroll engagement key 96. As shown in FIGS. 1 and 2, ring 90 is disposed between orbiting scroll member 56 and main bearing housing 24 with posts 92 extending through respective slots 98 in orbiting scroll member 56 for engagement with key 94 and respective slots 100 in non-orbiting scroll member 70 for engagement with keys 96.

In a prior art Oldham coupling having four keys in four locations, four of the key faces are tangent to the ring and four faces are normal to the ring. The faces that are normal to the ring are all contact surfaces. Thus, due to the fact that the four keys are located around the ring, the two diametrically located faces loaded by the non-orbiting scroll (on the main bearing housing) are perpendicular to the two diametrically located faces loaded by the orbiting scroll.

Oldham coupling 68 has posts 92 and thus keys 94 and 96 rotated a specified number of degrees, preferably between 30 and 60 degrees. In the preferred embodiment, one post 92 is rotated 55° and the other post 92 is rotated 57° from the horizontal axis as shown in FIG. 3. Thus, by arranging slots 98 and 100 accordingly, all four faces of posts 92 can be used to resist a moment. This allows non-orbiting scroll member 70 and orbiting scroll member 56 to use the same post. Orbiting scroll member 56 utilizes two opposed faces of key 94 at an elevation proximate to ring 90 while non-orbiting scroll member 70 utilizes the other two opposed faces of key 96 at an elevation distal to ring 90. Four keys, two each of keys 94 and 96, are provided for engagement with scroll members 56 and 70 but only two posts 92 are required. This design is more compact, lower weight and lower cost.

Figure 6:
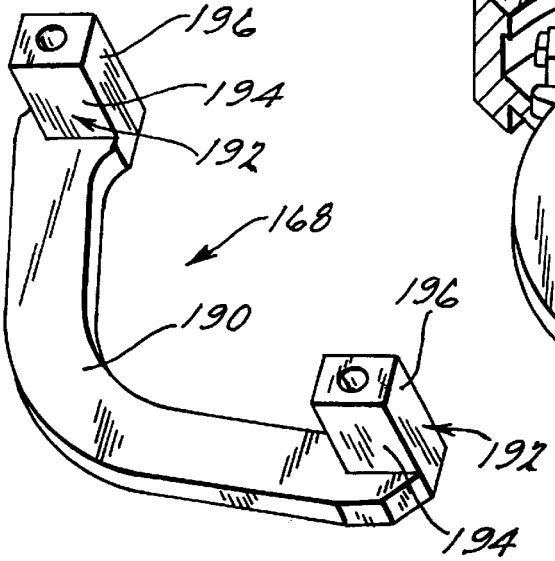
FIG. 6 is a perspective view of an Oldham coupling in accordance with another embodiment of the present invention.

Referring now to FIG. 6, an Oldham coupling 168 in accordance with another embodiment of the present invention is illustrated. Oldham coupling 168 comprises a curved bar 190 having two upwardly projecting diametrically opposing integral posts 192 positioned at opposing sides of curved bar 190. Each post 192 includes an orbiting scroll engagement key 194 and a non-orbiting scroll engagement key 196. Curved bar 190 is designed to be disposed between orbiting scroll member 56 and main bearing housing 24 with posts 192 extending through slots 98 in orbiting scroll member 56 for engagement with keys 194 and extending through slots 100 in non-orbiting scroll 70 for engagement with keys 196.

Oldham coupling 168 has posts 192 and thus keys 194 and 196 rotated similar to that of keys 94 and 96. Thus, all four faces of posts 192 can be used to resist a moment. This allows non-orbiting scroll member 70 and orbiting scroll member 56 to use the same post. Orbiting scroll member 56 utilizes two opposed faces of key 194 at an elevation proximate to curved bar 190 while non-orbiting scroll member 70 utilizes the other two opposed faces of key 196 at an elevation distal to curved bar 190. Four keys, two each of keys 194 and 196, are provided for engagement with scroll members 56 and 70 but only two posts 192 are required. This design is more compact, lower weight and lower cost.

Figure 7:
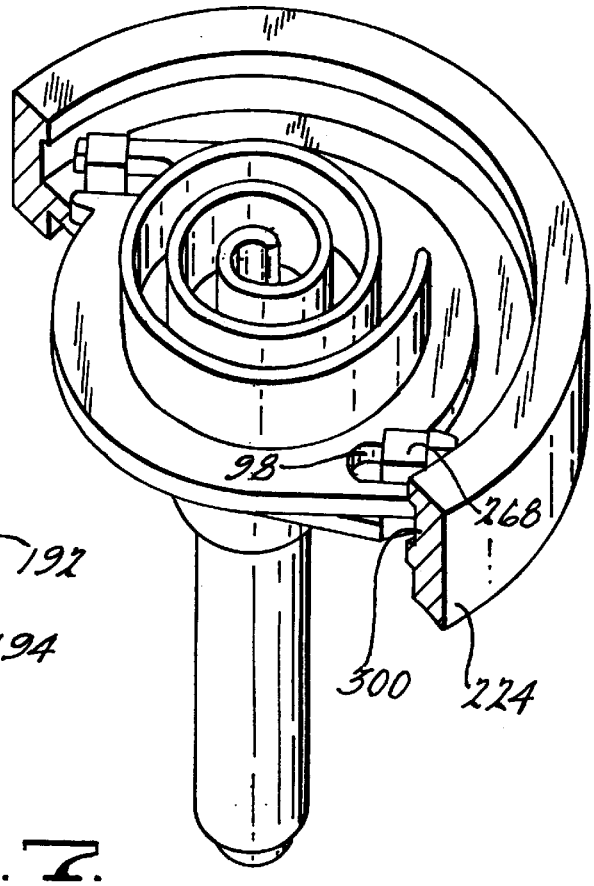
FIG. 7 is a schematic perspective view of a stationary component and a non-orbiting scroll member of a scroll machine connected to each other with an Oldham coupling in accordance with another embodiment of the present invention.
Figure 8:
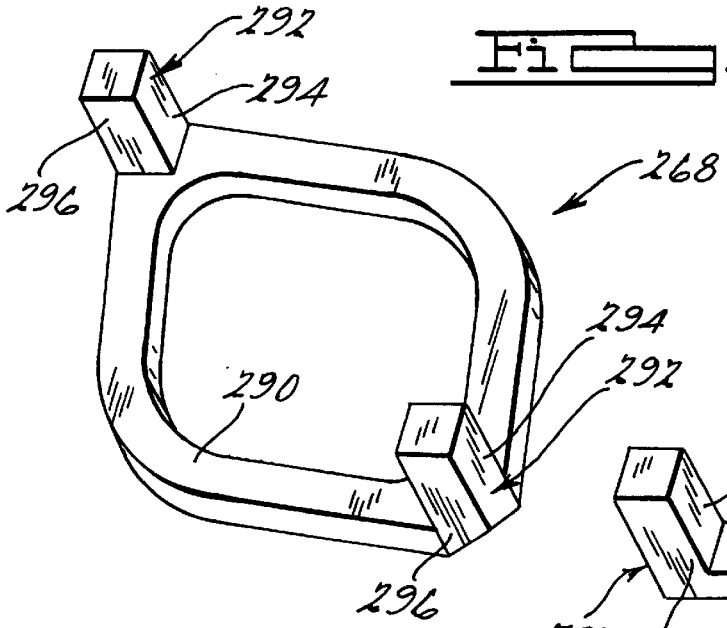
FIG. 8 is a perspective view of the Oldham coupling shown in FIG. 7.

Referring now to FIGS. 7 and 8, an Oldham coupling 268 in accordance with another embodiment of the present invention is illustrated. The embodiments illustrated in FIGS. 1–6 all show the Oldham coupling being keyed to both the non-orbiting scroll and the orbiting scroll. Another option that is available to the designer of scroll compressors is to key the Oldham coupling between the compressor body (i.e., the main bearing housing) and the orbiting scroll. This design for the Oldham coupling has both its advantages and its disadvantages as is well known in the art. As shown in FIG. 7, a main bearing housing 224 has been adapted for mating with Oldham coupling 268.

Oldham coupling 268 comprises a ring 290 having two upwardly projecting diametrically opposing integral posts 292. Each post 292 includes an orbiting scroll engagement key 294 and a main bearing housing engagement key 296. As shown in FIG. 7, ring 290 is disposed between orbiting scroll member 56 and main bearing housing 224 with posts 292 extending upward through respective slots 98 in orbiting scroll member 56 for engagement with keys 294 at a point distal from ring 290 and with posts 292 extending upward through respective slots 300 in main bearing housing 224 for engagement with keys 296 at a point proximate to ring 290.

Oldham coupling 268 has posts 292 and thus keys 294 and 296 rotated similar to that of keys 94 and 96. Thus, by arranging slots 98 and 300 accordingly, all four faces of posts 292 can be used to resist a moment. This allows main bearing housing 224 and orbiting scroll member 56 to use the same post. Orbiting scroll member 56 utilizes two opposed faces of key 294 at a position distal to ring 290 while main bearing housing 224 utilizes the other two opposed faces of key 296 at a position proximate to ring 290. Four keys, two each of keys 294 and 296, are provided for engagement with orbiting scroll member 56 and main bearing housing 224 but only two posts 292 are required. This design is more compact, lower weight and lower cost.

Figure 9:
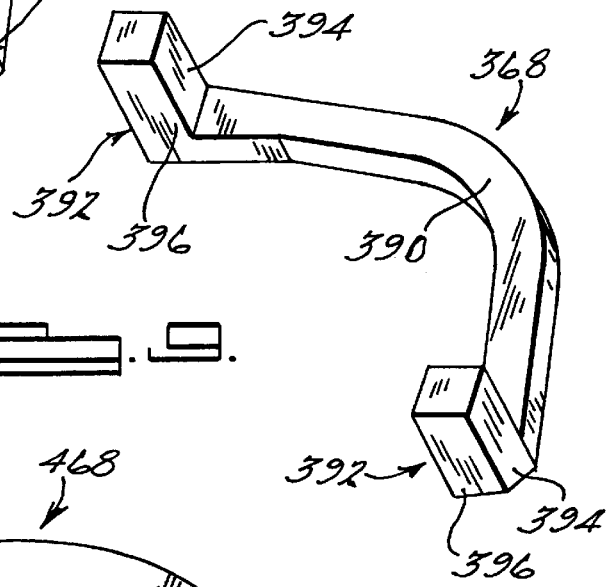
FIG. 9 is a perspective view of an Oldham coupling in accordance with another embodiment of the present invention.

Referring now to FIG. 9, and Oldham coupling 368 in accordance with another embodiment of the present invention is illustrated. Oldham coupling 368 comprises a curved bar 390 having two upwardly projecting diametrically opposing integral posts 392 positioned at opposing sides of curved bar 390. Each post 392 includes an orbiting scroll engagement key 394 and a main bearing housing engagement key 396. Curved bar 390 is designed to be disposed between orbiting scroll member 56 and main bearing housing 224 with posts 392 extending upwardly through slots 98 in orbiting scroll member 56 for engagement with keys 394 and extending upwardly through slots 300 in main bearing housing 224 for engagement with keys 396.

Oldham coupling 368 has posts 392 and thus keys 394 and 396 rotated similar to that of keys 94 and 96. Thus, all four faces of posts 392 can be used to resist a moment. This allows main bearing housing 224 and orbiting scroll member 56 to use the same post. Orbiting scroll member 56 utilizes two opposed faces of key 394 at a position distal to curved bar 390 while main bearing housing 224 utilizes the other two opposed faces of key 396 at a position proximate to curved bar 390. Four keys, two each of keys 394 and 396, are provided for engagement with orbiting scroll member 56 and main bearing housing 224 but only two posts 392 are required. This design is more compact, lower weight and lower cost.

Figure 10:
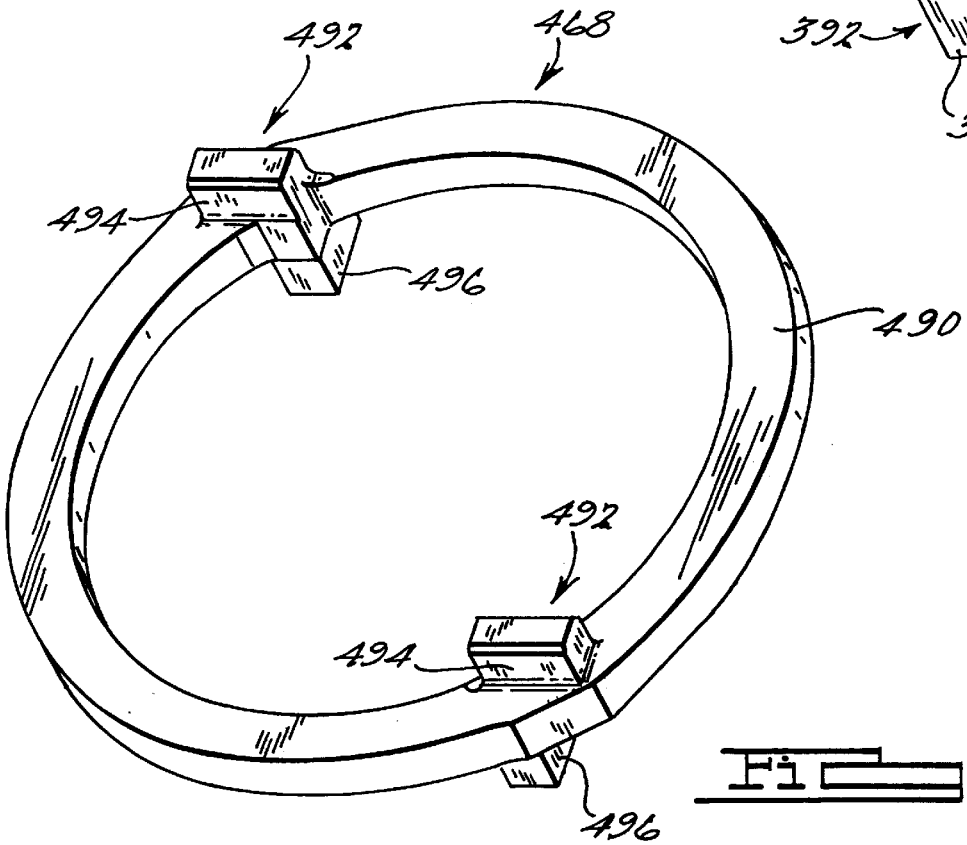
FIG. 10 is a perspective view of an Oldham coupling in accordance with another embodiment of the present invention.

Referring now to FIG. 10, an Oldham coupling 468 in accordance with another embodiment of the present invention is illustrated. Oldham coupling 468 is similar to Oldham coupling 268 shown in FIGS. 7 and 8 in that it is designed to be keyed to main bearing housing 224 and orbiting scroll member 56. Oldham coupling 468 comprises a ring 490 having two upwardly/downwardly projecting diametrically opposing integral posts 492. Each post 492 includes an orbiting scroll engagement key 494 and a main bearing housing engagement key 496. Ring 490 is designed to be located between orbiting scroll member 56 and main bearing housing 224 with posts 492 extending upward through respective slots 98 in orbiting scroll member 56 for engagement with keys 494 and with posts 492 extending downward through respective slots 300 in main bearing housing 224 for engagement with keys 496.

Oldham coupling 468 has posts 492 and thus keys 494 and 496 rotated similar to that of keys 94 and 96. Thus, by arranging slots 98 and 300 accordingly, all four faces of posts 492 can be used to resist a moment. This allows main bearing housing 224 and orbiting scroll member 56 to use the same post. Orbiting scroll member 56 utilizes two opposed faces of key 494 at a position on one side of ring 490 while main bearing housing 224 utilizes the other two opposed faces of key 496 on the other side of ring 480. Four keys, two each of keys 494 and 496, are provided for engagement with orbiting scroll member 56 and main bearing housing 224 but only two posts 492 are required. This design is more compact, lower weight and lower cost.

While the above detailed description describes the preferred embodiment of the present invention, it should be understood that the present invention is susceptible to modification, variation and alteration without deviating from the scope and fair meaning of the subjoined claims.

What is claimed is:

1. A scroll type machine comprising:

a first scroll member having a first spiral wrap projecting outwardly from a first end plate;

a second scroll member having a second spiral wrap projecting outwardly from a second end plate, said second scroll wrap being interleaved with said first spiral wrap to define a plurality of moving chambers therebetween when said second scroll member orbits with respect to said first scroll member;

a fixed member for supporting said first and second scroll members;

a drive member for causing said second scroll member to orbit with respect to said first scroll member, an Oldham coupling disposed between said second scroll member and one member of said first scroll member and said fixed member, said Oldham coupling preventing relative rotational movement between said first and second scroll members, said Oldham coupling comprising:

a first post engaging said second scroll member and said one member;

a second post engaging said second scroll member and said one member; and a connecting member disposed between said first and second posts.

2. The scroll machine according to claim 1, wherein said first post defines a first and a second face, said one member engaging said first face of said first post, said second scroll member engaging said second face of said first post.

3. The scroll machine according to claim 2, wherein said first face is generally perpendicular to said second face.

4. The scroll machine according to claim 2, wherein said first and second faces are disposed on the same side of said connecting member.

5. The scroll machine according to claim 2, wherein said first and second faces are disposed on opposite sides of said connecting member.

6. The scroll machine according to claim 2, wherein said second post defines a first and a second face, said one member engaging said first face of said second post, said second scroll member engaging said second face of said second post.

7. The scroll machine according to claim 6, wherein said first face of said first post is generally perpendicular to said second face of said first post and said first face of said second post is generally perpendicular to said second face of said second post.

8. The scroll machine according to claim 6, wherein said first and second faces of said first post and said first and second faces of said second post are disposed on the same side of said connecting member.

9. The scroll machine according to claim 6, wherein said first and second faces of said first post are disposed on opposite sides of said connecting member and said first and second faces of said second post are disposed on opposite sides of said connecting member.

10. The scroll machine according to claim 1, wherein said connecting member is an annular ring.

11. The scroll machine according to claim 10, wherein said first post defines a first and a second face, said one member engaging said first face of said first post, said second scroll member engaging said second face of said first post.

12. The scroll machine according to claim 11, wherein said first face is generally perpendicular to said second face.

13. The scroll machine according to claim 11, wherein said first and second faces are disposed on the same side of said connecting member.

14. The scroll machine according to claim 11, wherein said first and second faces are disposed on opposite sides of said connecting member.

15. The scroll machine according to claim 11, wherein said second post defines a first and a second face, said one member engaging said first face of said second post, said second scroll member engaging said second face of said second post.

16. The scroll machine according to claim 15, wherein said first face of said first post is generally perpendicular to said second face of said first post and said first face of said second post is generally perpendicular to said second face of said second post.

17. The scroll machine according to claim 15, wherein said first and second faces of said first post and said first and second faces of said second post are disposed on the same side of said connecting member.

18. The scroll machine according to claim 15, wherein said first and second faces of said first post are disposed on opposite sides of said connecting member and said first and second faces of said second post are disposed on opposite sides of said connecting member.

19. The scroll machine according to claim 1, wherein said one member is said first scroll member.

20. The scroll machine according to claim 19, wherein said first post defines a first and a second face, said first scroll member engaging said first face of said first post, said second scroll member engaging said second face of said first post.

21. The scroll machine according to claim 20, wherein said first face is generally perpendicular to said second face.

22. The scroll machine according to claim 20, wherein said first and second faces are disposed on the same side of said connecting member.

23. The scroll machine according to claim 20, wherein said second post defines a first and a second face, said first scroll member engaging said first face of said second post, said second scroll member engaging said second face of said second post.

24. The scroll machine according to claim 23, wherein said first face of said first post is generally perpendicular to said second face of said first post and said first face of said second post is generally perpendicular to said second face of said second post.

25. The scroll machine according to claim 23, wherein said first and second faces of said first post and said first and second faces of said second post are disposed on the same side of said connecting member.

26. The scroll machine according to claim 1, wherein said one member is said fixed member.

27. The scroll machine according to claim 26, wherein said first post defines a first and a second face, said fixed member engaging said first face of said first post, said second scroll member engaging said second face of said first post.

28. The scroll machine according to claim 27, wherein said first face is generally perpendicular to said second face.

29. The scroll machine according to claim 27, wherein said first and second faces are disposed on opposite sides of said connecting member.

30. The scroll machine according to claim 27, wherein said second post defines a first and a second face, said fixed member engaging said first face of said second post, said second scroll member engaging said second face of said second post.

31. The scroll machine according to claim 30, wherein said first face of said first post is generally perpendicular to said second face of said first post and said first face of said second post is generally perpendicular to said second face of said second post.

32. The scroll machine according to claim 30, wherein said first and second faces of said first post are disposed on opposite sides of said connecting member and said first and second faces of said second post are disposed on opposite sides of said connecting member.

* * * * *